US005500083A

United States Patent [19]

Johanson

[11] Patent Number: 5,500,083

[45] Date of Patent: Mar. 19, 1996

[54] METHOD OF FEEDING CELLULOSIC MATERIAL TO A DIGESTER USING A CHIP BIN WITH ONE DIMENSIONAL CONVERGENCE AND SIDE RELIEF

[75] Inventor: Jerry R. Johanson, San Luis Obispo, Calif.

[73] Assignee: Kamyr, Inc., Glens Falls, N.Y.

[21] Appl. No.: 189,546

[22] Filed: Feb. 1, 1994

[51] Int. Cl.[6] ..... D21C 7/06

[52] U.S. Cl. ..... 162/17; 162/246; 162/250; 222/460

[58] Field of Search ..... 162/17, 246, 250, 162/52; 222/460, 462

[56] References Cited

U.S. PATENT DOCUMENTS

| | | | |
|---|---|---|---|
| 2,960,161 | 11/1960 | Richter | 162/246 |
| 3,041,232 | 6/1962 | Richter et al. | 162/17 |
| 3,429,773 | 2/1969 | Richter | 162/237 |
| 4,071,399 | 1/1978 | Prough | 162/16 |
| 4,096,027 | 6/1978 | Sherman | 162/18 |
| 4,124,440 | 11/1978 | Sherman | 162/246 |
| 4,513,515 | 4/1985 | Richter et al. | 34/33 |
| 4,637,878 | 1/1987 | Richter et al. | 162/243 |
| 4,721,231 | 1/1988 | Richter | 222/146.4 |
| 4,867,845 | 9/1989 | Elmore | 162/243 |
| 4,958,741 | 9/1990 | Johanson | 220/83 |

FOREIGN PATENT DOCUMENTS

| | | |
|---|---|---|
| 1146788 | 5/1983 | Canada . |
| 1154622 | 10/1983 | Canada . |
| WO92/16442 | 10/1992 | WIPO . |

OTHER PUBLICATIONS

Johanson, "Binside Scoop" Newsletter, Summer 1993, vol. 6, No. 1, JR Johansson Inc.

"Binside Scoop" Newsletter, Summer, 1993, vol. 6, No. 1, JR Johanson Inc.

"Diamondback Hoppers® Revitalize Flour Mill's Operation" brochure, 1993, JR Johanson Inc.

*Primary Examiner*—Peter Chin
*Assistant Examiner*—Dean T. Nguyen
*Attorney, Agent, or Firm*—Nixon & Vanderhye

[57] ABSTRACT

A chip bin construction, ideally suited for bins having a maximum diameter of twelve feet or more, uniformly discharges chips, after steaming, without the necessity of a vibratory discharge. A hollow transition portion is provided between a hollow substantially right circular cylindrical main body and a rectangular discharge. The hollow transition may have a substantially circular cross-section open top and a substantially rectangular cross-section open bottom and opposite non-vertical gradually tapering side walls. At least one feed screw may be mounted at the open bottom of the transition for cooperation with the discharge, and the feed screw(s)—or the equivalent— may provide for metering of the chips. Alternatively, the hollow transition portion may provide one dimensional convergence and side relief, and no screw feeders need be provided, in which case a conventional chip meter is used.

16 Claims, 9 Drawing Sheets

FIG. 13
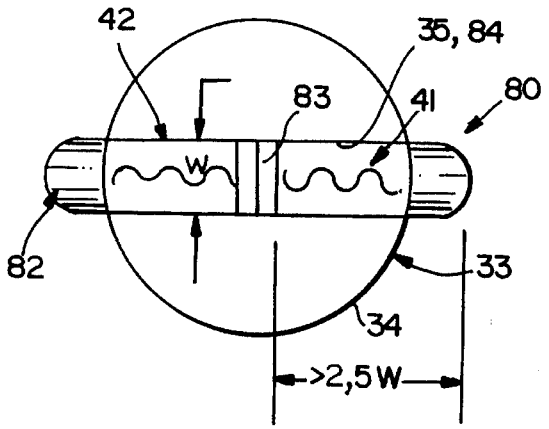
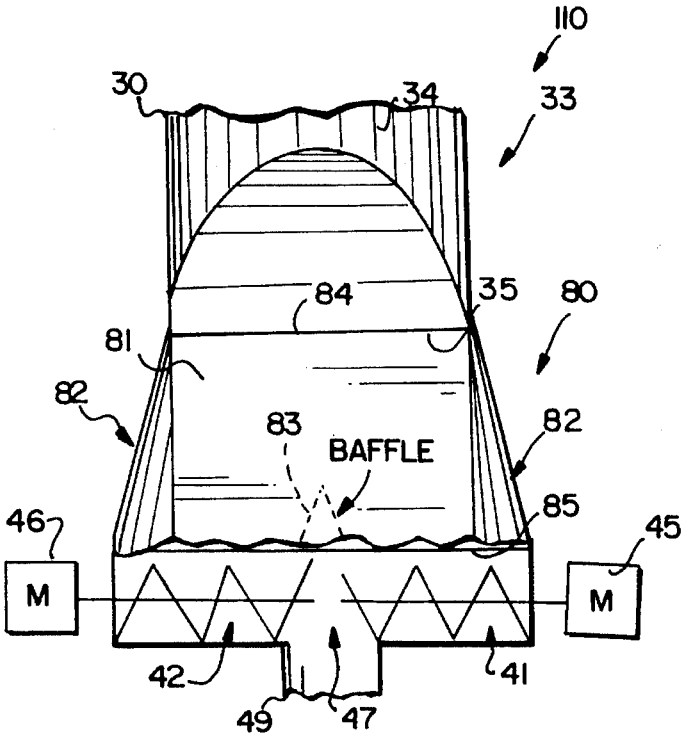
FIG. 11
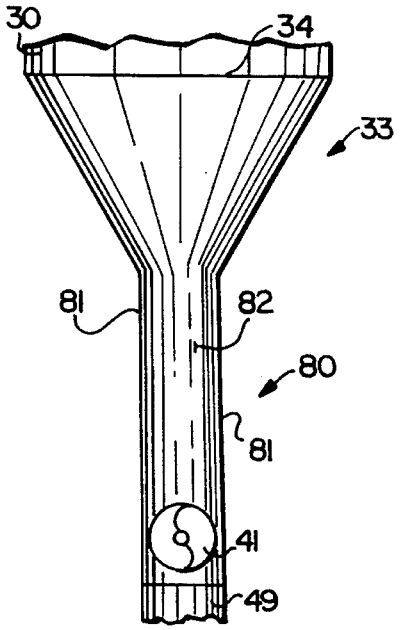
FIG. 12

FIG. 14
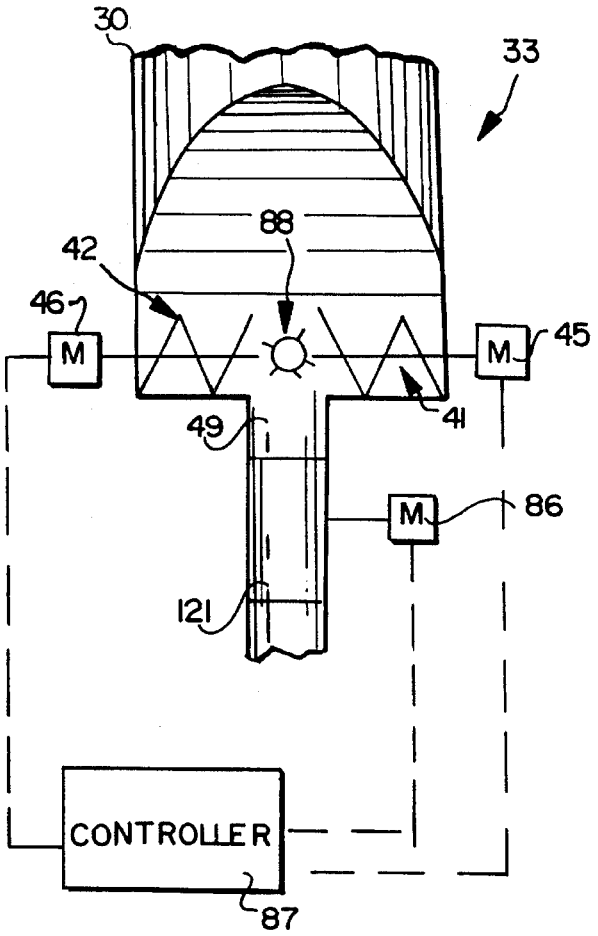
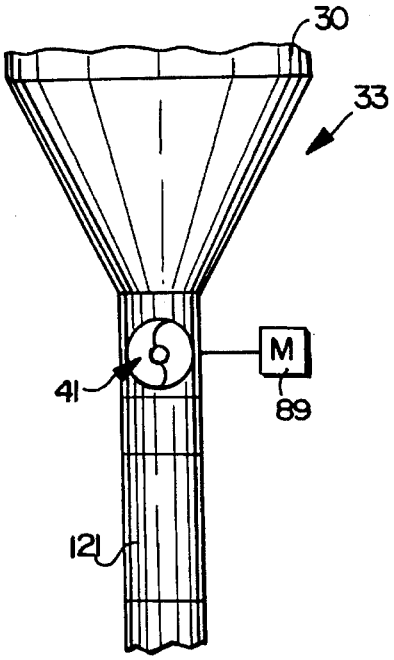
FIG. 15

METHOD OF FEEDING CELLULOSIC MATERIAL TO A DIGESTER USING A CHIP BIN WITH ONE DIMENSIONAL CONVERGENCE AND SIDE RELIEF

BACKGROUND AND SUMMARY OF THE INVENTION

In the production of chemical cellulose pulp (e.g. paper pulp) it is highly desirable to obtain uniformity of treatment. One important way that this uniformity is typically achieved or approached is to provide uniform impregnation of the cooking liquor (e.g. white liquor) into the comminuted cellulosic raw material (typically wood chips). In order for there to be uniform impregnation the air must be removed from the chips, and this is typically done by steaming.

In approximately the 1970s, it became common to at least initiate steaming of the chips at an early stage in their treatment by supplying steam to a conventional vertical vessel known as a "chip bin". In most systems, chips were ted into the top of the chip bin, e.g. through an air lock, where they were subjected to steam before moving downwardly through the bin into a chip meter, and then a low pressure feeder, subsequently to a horizontal steaming vessel where the removal of air in the chips with steam was completed, and then either a teed mechanism on top of a batch digester, or more commonly to a high pressure feeder for a continuous digester. In addition to providing a volume for initial steaming, the chip bin provides a storage volume sufficient to insure supply of the continuous digester, and/or like components, on a regular basis even though the chips are not continuously fed from a chip heap or pile to the pulping system. This is especially important in winter weather conditions in cold climates, where many pulp mills are located, because of interruptions in an ability to continuously feed chips from a heap or pile to the pulping system due to freezing of the chips in the pile, or other weather related disruptions. Numerous problems of channeling or "rat-holing" are caused by inhomogeneous chip feed. Frozen chips have different flow properties than normal chips, wet different than dry, and sawdust and pin chips different than whole chips.

It has long been known that when wood chips (and like comminuted cellulosic material) funnel downwardly in a chip bin, or similar vessel, to a discharge having a smaller cross-sectional area than the area of the vessel (chip bin) itself there is a tendency for the chips to hang up or bridge. Also some areas allow channelling of the chips to the discharge, while in other areas the chips move little. This is a significant problem because it can interrupt the continuity of supply and thereby defeat a major purpose of a chip bin. Therefore since at least as early as the 1970s conventional chip bins have often included a vibratory discharge mechanism which continuously or periodically shakes the discharge, minimizing bridging and the possibility of plugging, and promoting uniform flow of chips through all portions of the chip bin. One such conventional vibratory discharge is shown in U.S. Pat. No. 4,124,440 and Canadian Patent 1,146,788, both of which also show conventional mechanisms for steaming the chips while in the chip bin.

While vibratory discharges for chip bins have long been the commercially preferred way of preventing bridging, and have long worked well, as the size of pulping systems—and therefore the size of the chip bin associated therewith—has increased in the 1980s and 1990s, there have been increasing practical operational difficulties. In fact for chip bins having a maximum diameter of over about twelve feet (and certainly over fourteen feet) problems in plugging, bridging, and channeling have increased (especially for some woods, such as cedar), as have maintenance and reliability problems associated with the vibratory discharges. Some of these problems can be greatly alleviated or solved by using conical inserts for the chip bin as shown in copending application Ser. No. 08/130,525 filed Oct. 1, 1993 (attorney docket 10-849, the disclosure of which is hereby incorporated by reference herein), however even with the system and method described therein maintenance and reliability problems of a vibratory discharge, or other problems, may still occur for chip bins having a maximum diameter of about twelve feet or more.

According to the present invention, a method and apparatus are provided which specifically address the problems of reliability and maintenance of conventional vibratory discharges, and the problems of chip bin pluggage, bridging and/or channelling. While the invention is primarily directed to chip bins having a maximum diameter of about twelve feet or more, many aspects thereof are appropriate for bins in general, and of almost any size. The invention utilizes mass flow (as contrasted with the "funnel flow" of copending application Ser. No. 08/130,525) in the chip bin, which has significant benefits in promoting uniform steaming, and in minimizing channeling.

According to the invention, the vibratory discharge is replaced with a simpler, less troublesome, more easily maintained structure while not only not sacrificing discharge efficiency and the ability to steam the chips, but actually enhancing them. Also, in some of the embodiments of the invention, the chip meter—a conventional and necessary piece of equipment associated with most chip bins for continuous digester systems—can be eliminated without elimination of its metering function, thereby resulting in the potential for equipment and maintenance savings for the chip feeding system as a whole.

According to the general method of the present invention, comminuted cellulosic material is ted to a digester using a vertical open interior chip bin having a top and bottom, and a maximum diameter of about twelve feet or more (e.g. fourteen feet or more), and a discharge operatively connected to a digester. The discharge has a cross-sectional area much less than half of the cross-sectional area of the chip bin (e.g. less than one-tenth). The method comprises the steps of: (a) Feeding the comminuted cellulosic material into the top of the chip bin, to flow downwardly in a column in the chip bin toward the bottom. (b) Causing the comminuted cellulosic material to move into a gradually restricting open flow path in the open interior of the chip bin having a cross-sectional area less than half of the area at the maximum diameter of chip bin. (c) Without vibrating the chip bin or the chip bin discharge, causing a substantially uniform flow of comminuted cellulosic material in the gradually restricting open flow path, substantially without bridging or hangups of the comminuted cellulosic material in the flow path. (d) Steaming the comminuted cellulosic material while in the chip bin. And, (e) discharging the comminuted cellulosic material from the chip bin discharge and feeding it to the digester.

Step (e) may be practiced by feeding the material directly from the discharge to a low pressure feeder and then ultimately to a digester, or alternatively the material may be fed directly from the discharge to a chip meter, and then ultimately to the digester. Steps (b) and (c) may be practiced by causing the comminuted cellulosic material to flow into two distinct volumes each comprising about half of a main volume defined by a substantially circular cross-section top and a substantially rectangular cross-section bottom, and a larger cross-sectional area at the top thereof than at the bottom thereof, and opposite non-vertical gradually tapering sides, and causing the material to move from each distinct volume to the discharge using oppositely rotating feed screws (or opposite handed feed screws rotated by a common shaft), the discharge being located approximately midway between the two distinct volumes. Steps (b) and (c) may be further practiced by causing the material to flow into distinct volumes wherein the degree of taper of the opposite non-vertical gradually tapering sides is about 20°–35°. Alternatively, steps (b) and (c) may be practiced by causing the comminuted cellulosic material to flow through a transition having one dimensional convergence and side relief between a first volume having a circular cross-section of at least about twelve feet and a discharge having a circular cross-section of much less than half of the first volume.

Step (d) is typically practiced by adding steam to the distinct volumes by introducing the steam into a substantially vertical chip bin wall interruption in at least one non-vertical gradually tapering side of each of the distinct volumes.

According to another aspect of the present invention a bin is provided in general. While the bin has specific utility as a chip bin, particularly for diameters of about twelve feet or more, it is useful for almost any size chip bin, and for other bin constructions in general. According to this aspect of the invention the bin comprises: A hollow substantially right circular cylindrical main body portion having a substantially vertical central axis, a top and an open bottom. A top wall closing off the top of the main body portion, and having means for introducing particulate material into the hollow main body portion mounted thereon. A hollow transition portion connected to the bottom of the main body portion having a substantially circular cross-section open top and a substantially rectangular cross-section open bottom, and a larger cross-sectional area at the top thereof than at the bottom thereof, and opposite non-vertical gradually tapering side walls. At least one feed screw mounted adjacent the open bottom of the transition portion, in a housing. A discharge operatively connected to the teed screw housing. And, means for rotating the at least one feed screw to move particulate material from the bottom of the transition portion to the discharge.

The bin may further comprise means for introducing steam to the hollow transition portion, the means comprising a steam conduit, and a substantially vertical wall interruption of at least one of the non-vertical gradually tapering side walls of the transition portion, the steam conduit connected to the substantially vertical wall interruption. The non-vertical gradually tapering side walls of the transition portion may each have a degree of taper that is about 20°–35° (typically about 25°–30°) with respect to vertical, which is about 10°–20° greater than the mass flow angle for the material handled (the mass flow angle for most chips is about 10°–15°).

The at least one feed screw may comprise first and second feed screws mounted at the bottom of the transition portion, a junction provided between the screws, and each mounted for rotation about a common generally horizontal axis; and the means for rotating the at least one feed screw may comprise means for rotating the first and second screws about the axis in different directions (or opposite handed feed screws rotated by a common shaft). The structure also preferably includes a baffle disposed within the transition portion above the screw junction; and, the discharge may comprise a substantially right rectangular parallelepiped discharge operatively mounted to the screws substantially at the screw junction and remote from the transition portion, the discharge for receipt of particulate solid material from both the screws.

Alternatively the discharge may be offset from the main body portion in which case the at least one screw comprises a single screw that transports particulate material substantially horizontally in a single direction from the transition portion to the offset discharge.

As another embodiment, the at least one screw comprises first and second screws, one mounted above the other for rotation about parallel axes, the first screw having a housing mounted to the transition portion and having an outlet therefrom offset from the main body portion, and the second screw having a housing with an inlet connected to the first screw housing outlet, and having the discharge as the outlet, the discharge being substantially concentric with the main body portion. In this case the means for rotating the at least one screw comprises means for rotating the first and second screws so that they transport particulate material in opposite substantially horizontal directions.

According to yet another modification, the transition portion comprises a first transition portion, and further comprises a second hollow transition portion between the first transition portion and the at least one screw, the second transition comprising a hollow substantially right triangular prism with an open top and open bottom and having a larger cross-sectional area at the bottom than at the top, and the cross-sectional area of the top being approximately the same as the cross-sectional area of the bottom of the first transition portion. The bottom of the second transition portion has a length at least five times its width; and the discharge frown the screw trough is a rectangular in cross section, having a diameter approximately equal to the width of the bottom of the second transition portion, and is substantially concentric with the main body portion.

According to a still further embodiment the at least one feed screw comprises first and second feed screws mounted at the bottom of the transition portion, a junction provided between the screws and each mounted for rotation about a common generally horizontal axis. The means for rotating the feed screw comprises means for rotating the first and second screws about the axis in different directions. The discharge from the screw trough may comprise a substantially right rectangular parallelepiped discharge operatively mounted to the screw substantially at the screw junction and remote from the transition portion, the discharge for receipt of particulate solid material from both the screws. An agitator may also be provided at the screw junction, and a chip meter, operated by a motor, may be connected to the discharge. A controller coordinates the operation of the chip meter motor and the means for rotating the first and second screws.

According to another aspect of the present invention a chip bin assembly is provided comprising the following elements: A hollow substantially right circular cylindrical main body portion having a substantially vertical central axis, a top and a bottom, and having a first diameter. A top wall closing off the top of the main body portion, and having means for introducing wood chips into the hollow main body portion mounted thereon. A hollow substantially right rectangular parallelepiped discharge having a second diameter with is less than one half of the first diameter. A hollow transition portion disposed between the main body portion and the discharge having one dimensional convergence and side relief. Means for introducing steam to the hollow interior of the bin. And, means for connecting the discharge to a digester.

The assembly may also comprise first and second feed screws mounted adjacent the bottom of the transition portion, a junction provided between the screws, and each mounted for rotation about a common generally horizontal axis; and means for rotating the screws about the axis in different directions (or opposite handed feed screws rotated by a common shaft) to move wood chips from the transition portion to the discharge conduit. Alternatively the transition portion may include at least one substantially planar non-vertical wall portion; and the means for introducing steam into the bin preferably introduces steam into the transition portion, and comprises a steam conduit, and a substantially vertical wall interruption of the substantially planar non-vertical wall portion of the transition portion, the steam conduit connected to the substantially vertical wall interruption.

It is the primary object of the present invention to provide for the effective feeding of particulate material, such as wood chips, downwardly in a bin without the necessity of a vibratory discharge, even where the diameter of the bin is twelve feet or more. This and other objects of the invention will become clear from an inspection of the detailed description of the invention and from the appended claims.

BRIEF DESCRIPTION OF THE DRAWINGS

FIGS. 11 and 12 are views like those of FIGS. 2 and 3, but for only the transition and screw component portions, of a further modification of the chip bin embodiment of FIGS. 2 and 3;

FIG. 13 is a top plan view of the transition and like portions of the embodiment of FIGS. 11 and 12;

FIGS. 14 and 15 are views like those of FIGS. 2 and 3 for yet another modification of the transition, screw feed, and like components, of a chip bin according to the invention.

DETAILED DESCRIPTION OF THE DRAWINGS

Figure 1:
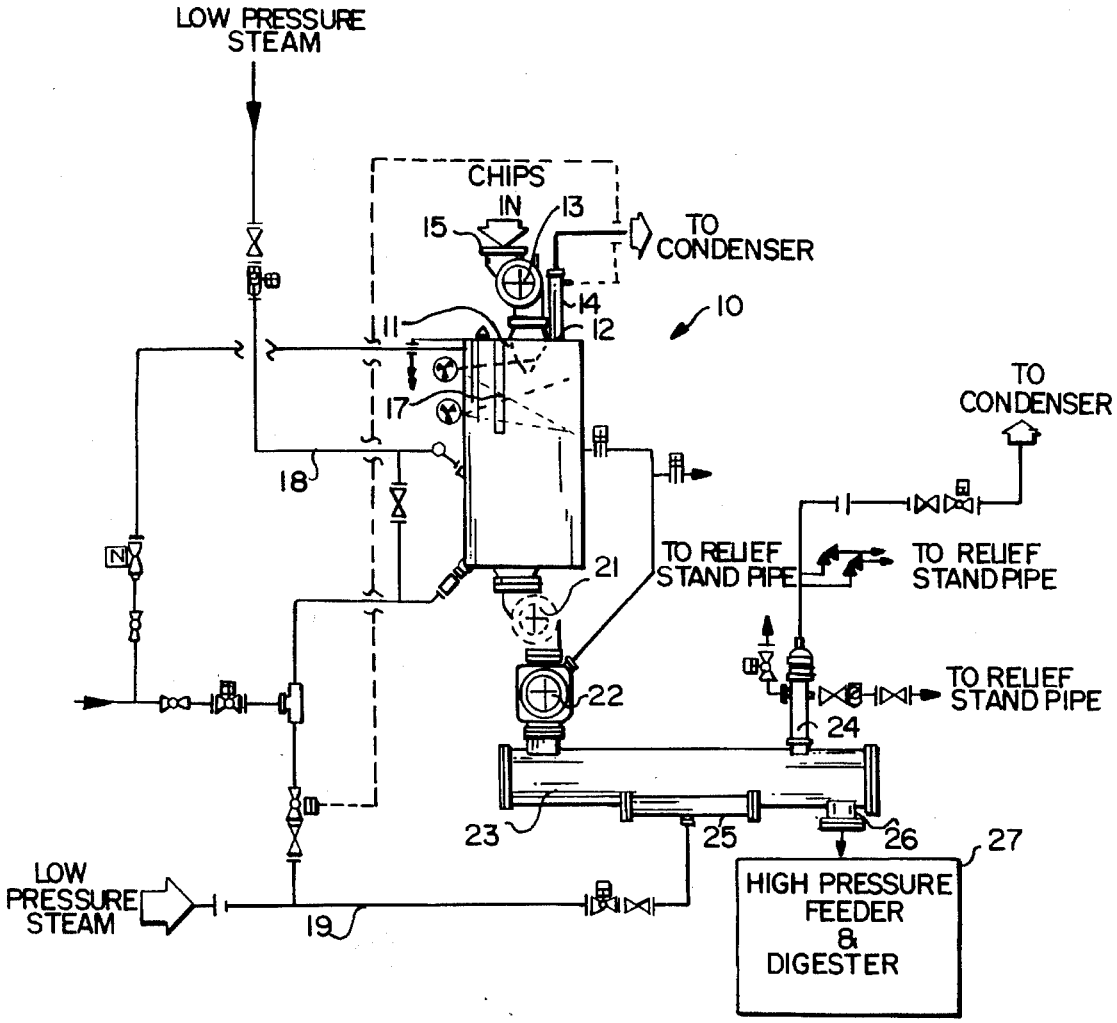
FIG. 1 is a schematic side view of a chip bin according to the present invention in association with conventional other equipment for the production of chemical pulp.

FIG. 1 schematically illustrates a chip bin 10 according to the present invention, having a closed top 11 with a conventional inlet 12 in the top thereof for the introduction of wood chips or other comminuted cellulosic material. As is conventional an air lock 13 is preferably connected to the inlet 12, and a vent pipe 14 is next to the inlet 12. Chips are introduced through the air lock 13 in the conduit 12 through the top 11 of the chip bin 10, as indicated schematically by arrow 15. The chip bin 10 also has other conventional vents, reliefs, and the like associated therewith, and also typically has an internal level sensing mechanism, such as a conventional gamma source level control illustrated schematically by reference numeral 17 in FIG. 1.

Steam is supplied to the chip bin 10 to start steaming of the chips within it. The steam is typically low pressure steam, such as provided through lines 18 and 19 from conventional sources within the pulp mill. Line 18, in the exemplary embodiment illustrated, is shown connected to the main body portion of the chip bin 10, while line 19 is operatively connected to a lower portion thereof. The mechanisms for control of the steam addition to the chip bin, and for sensing and control of the level of chips within the bin 10, the control of air lock 13, and the control of various vents associated therewith, are conventional.

The chip bin 10 is a vertical vessel with a discharge at the bottom thereof typically connected to a chip meter 21. The chip meter 21 is shown illustrated in dotted line in FIG. 1 since it is not necessary in all embodiments of the chip bin according to the invention. In some of the embodiments of the chip bin according to the invention metering action is inherently provided by components of the chip bin which take the place of a conventional vibratory discharge (such as shown in U.S. Pat. No. 4,124,440). Below the chip bin 10, and below the chip meter 21 if provided, is a low pressure feeder 22 which feeds the chips after initial steaming from the chip bin 10 into a conventional horizontal steaming vessel 23. The vessel 23 typically has a vent conduit 24, and a header 25 connected to the low pressure steam source 19 for the introduction of steam, and a chips outlet 26. An internal screw is typically provided in the steaming vessel 23. From the outlet 26 the steamed chips are then fed—as illustrated schematically at 27 in FIG. 1—to a high pressure feeder and continuous digester, or to a feed mechanism on top of a batch digester, or the like, through various conventional treatment and/or feed mechanisms.

FIGS. 2 through 17 illustrate various embodiments and details of the chip bin 10 of FIG. 1. However all of the accessories such as an air lock, vent pipes, steam conduits, etc. are not shown associated therewith, but would of course commonly be provided. While the chip bin 10 according to the present invention typically has a maximum diameter of twelve feet or more (typically fourteen feet or more), which is where significant problems occur in conventional systems having vibratory discharges, there are many aspects of the invention that are applicable to chip bins of any size, and some aspects of the invention applicable to bins in general. In all the embodiments, the internal conical-insert bin, construction of co-pending application Ser. No. 08/130,525 may be utilized.

FIGS. 2 through 5 illustrate one embodiment of a chip bin according to the invention which may be referred to as a "chisel design". In this embodiment, as in all embodiments of the chip bin according to the invention, the vibratory discharge conventional in prior art chip bins has been eliminated. In the FIGS. 2 through 5 embodiment components comparable to those in FIG. 1 are shown by the same reference numeral only preceded by a "1".

The chip bin 110 includes a hollow substantially right circular cylindrical main body portion 30 having a substantially vertical central axis, a top 111, and an open bottom 29. It has a maximum (and preferably substantially uniform) internal diameter 31, which typically is twelve feet or more (e.g. fourteen feet or more, for example sixteen feet). The top 111 is defined by a top wall which has the conduit 112 (connected to the conventional air lock, etc., not shown in FIGS. 2 through 5) which comprises means for introducing particulate material, typically wood chips or other comminuted cellulosic fibrous material, into the main body portion 30. A steam introduction header 32, which introduces steam at a plurality of points around the circumference of the main body 30, may be provided as the sole, or as one of several, mechanisms for steaming chips within the bin 110.

Figure 3:
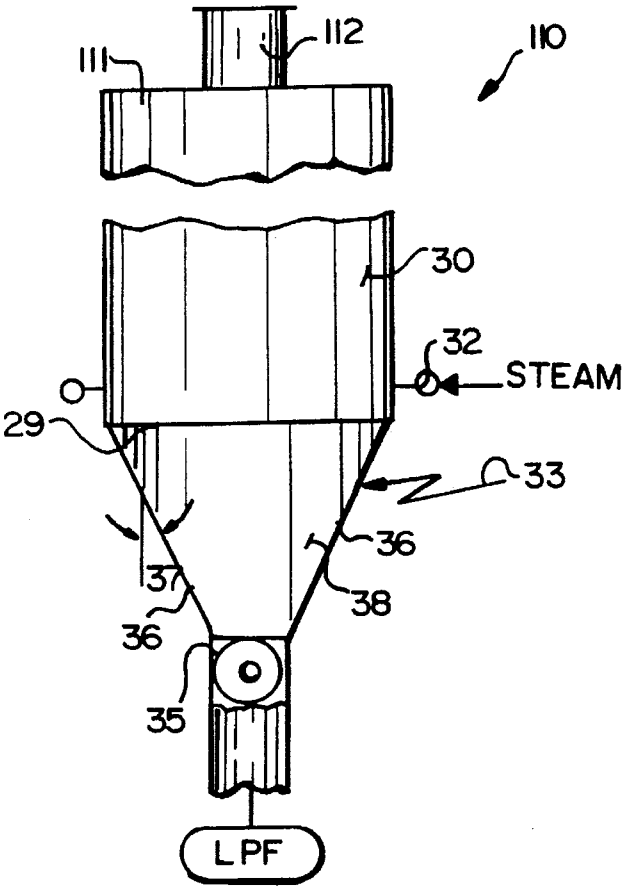
FIG. 3 is a side view, with the screw motor and end housing removed for clarity of illustration, of the chip bin embodiment of FIG. 2.
Figure 4:
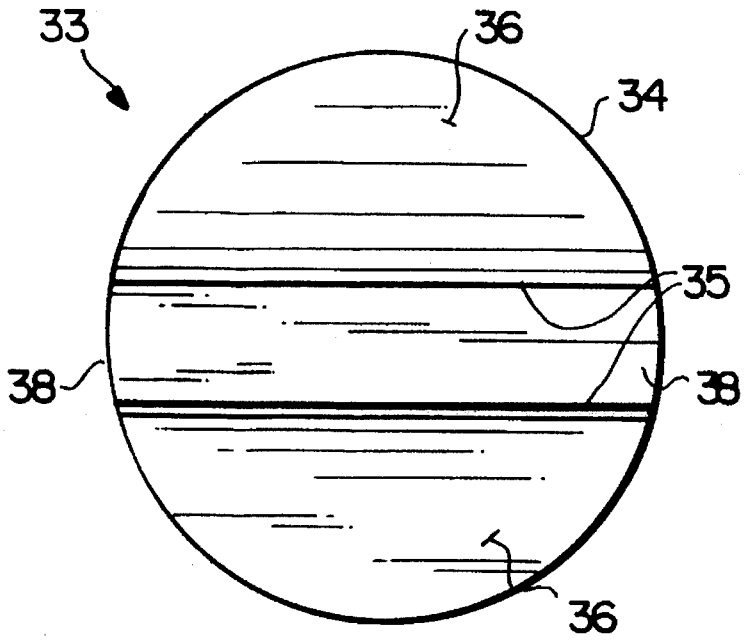
FIG. 4 is a top plan view of the transition portion of the chip bin of FIGS. 2 and 3.

The bin 110 also comprises a hollow transition portion 33 having a substantially circular cross-section open top 34 and a substantially rectangular cross-section open bottom 35 (see FIG. 4 in particular). The transition portion 33 top 34—which is continuous with the bottom 29 of the main body portion 30—has opposite side non-vertical gradually tapering side walls 36. The side walls 36 make an angle 37 (see FIG. 3) with respect to the vertical, which angle 37 is typically about 20°–35°, and preferably about 25°– 30°, but will vary depending upon the particular material handled by the bin 110 (e.g. the particular species of wood chips commonly used). So that a smooth geometric transition between the circular configuration of the main body portion 30 and the substantially rectangular bottom 35 of the transition 33 is provided, the ends 38 of the transition 33 are continuously curved surfaces, as indicated by the shading in FIGS. 2 and 3, and as also seen in FIG. 4. Typically, the main body portion 30 is welded to the transition portion 33 to provide a continuous fluid-tight wall so that steam introduced into the hollow interior of the portions 30, 33 cannot escape, except through designed vents. Note that the transition 33 has a height 39 which is typically less than the diameter 31 (e.g. in one embodiment for a diameter 31 of sixteen feet the height 39 would be about twelve feet).

Figure 2:
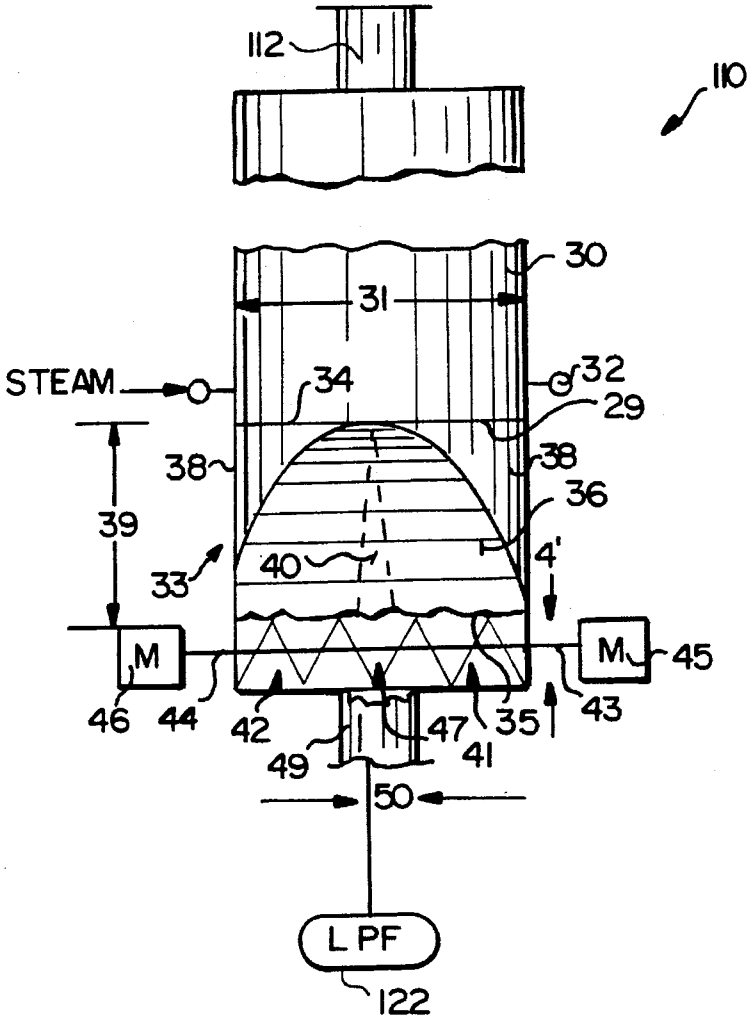
FIG. 2 is a schematic front view, with some portions cut away for clarity of illustration of the internal components, of one embodiment that the chip bin of FIG. 1 can take.

In the FIG. 2 embodiment a baffle 40 is illustrated within the transition 33 for causing the chips flowing downwardly from the main body portion 30 to flow into two different volumes on opposite sides thereof. For clarity of illustration of the other components the baffle 40 is not seen in FIG. 4, but spans the entire volume between the non-vertical gradually tapering side walls 36, and makes an angle with respect to the vertical approximately the same as the angle 37.

Located adjacent the open bottom 35 of the transition 33, therebelow, is at least one feed screw mounted in a housing which is connected to the bottom 35. In the embodiment of FIGS. 2 and 3, two feed screws 41, 42 are provided mounted on separate shafts 43, 44 driven by motors 45, 46 respectively, and with a junction 47 therebetween. The details of the bearings, etc. for mounting the shafts 43, 45 are not illustrated, nor are the details of the teed screws 41, 42. The feed screws 41, 42 are conventional per se, and may be single screws, multiple screws, or any suitable conventional type. The motors 45, 46 rotate the screws 41, 42 in opposite directions, so that the screws teed the chips toward the middle (below the baffle 40), typical screw speeds being about 10–100 rpm. Alternatively and just as preferred (though not shown in the drawings) the first and second feed screws 41, 42 may be different hand (right and left) screws on a common shaft (43) rotated by a common motor (45). In both cases the screws are "oppositely directed".

The housing for the screws 41, 42 preferably has substantially the same width as the width of the open bottom 35 of the transition 33. Operatively connected to the feed screw housing remote from the transition 33 (typically on the opposite side thereof) is the discharge 49. The discharge 49 typically comprises a hollow substantially right rectangular parallelepiped conduit, connection, or transition, centrally located just below the junction 47, and having a diameter 50 which is approximately the same as the width of the housing for the screws 41, 42 (essentially the same as the screw 41, 42 diameters). In order for maximum feeding efficiency to exist, associated with the "chisel" shaped transition 33, the length of each screw 41, 42 should be at least about 2.5 times the diameter of the screws, and these dimensions will be taken into account when designing the diameter 50, the screws 41, 42, etc.

As seen in FIGS. 2 and 3, the discharge 49 may be connected directly to a conventional low pressure feeder 122 (that is a chip meter is not necessary), and in fact the discharge 49 may comprise the inlet connection to the low pressure feeder 122. Since the screws 41, 42 provide a metering action (which is controlled by controlling the speed of rotation thereof by controlling the motors 45, 46) the typically necessary chip meter (21 in FIG. 1) can be eliminated.

Instead of screws other equivalent metering and transporting elements may be used, e.g. star feeders.

Figure 5:
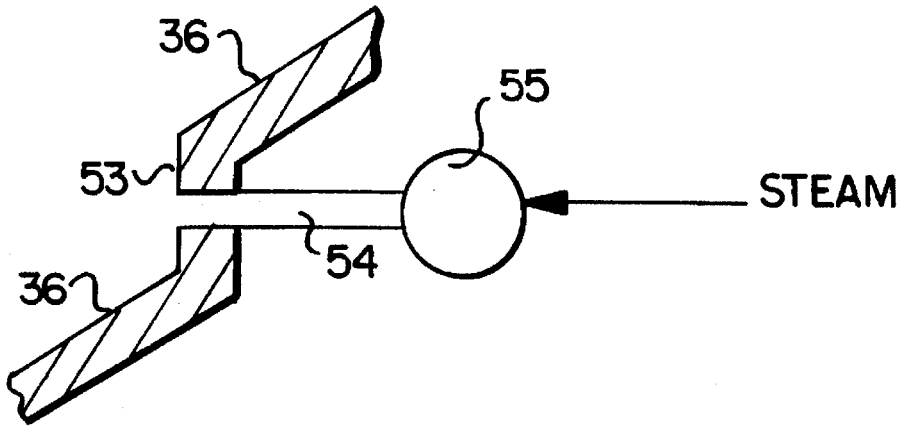
FIG. 5 is a side detail cross-sectional view schematically illustrating the manner in which steam can be introduced into the transition portion of the chip bin of FIGS. 2 through 4.

Instead, or in addition to, introducing steam into the chip bin 110 using the steam introduction header 32, steam may be introduced into the transition 33. The preferred manner in which this is done is illustrated in FIG. 5. Steam introduction is not effective in inwardly angled walls such as the gradually tapering side walls 36 of the transition 33 since the steam ports would have a tendency to clog. However this problem is alleviated according to the present invention, as illustrated in FIG. 5, by providing a substantially vertical wall interruption 53 of at least one of the non-vertical gradually tapering side walls 36 (and preferably at multiple locations along each of the walls 36). A steam conduit 54, such as connected to a steam header 55 supplied with low pressure steam, penetrates the transition 33 at the substantially vertical wall interruption 53, the interruption 53 being a minor discontinuity in the slope of the wall 36. The arrangement of FIG. 5 is provided in each of the subsequent embodiments of chip bins according to the invention, but will not be shown or described in detail with respect to the other embodiments.

Figure 7:
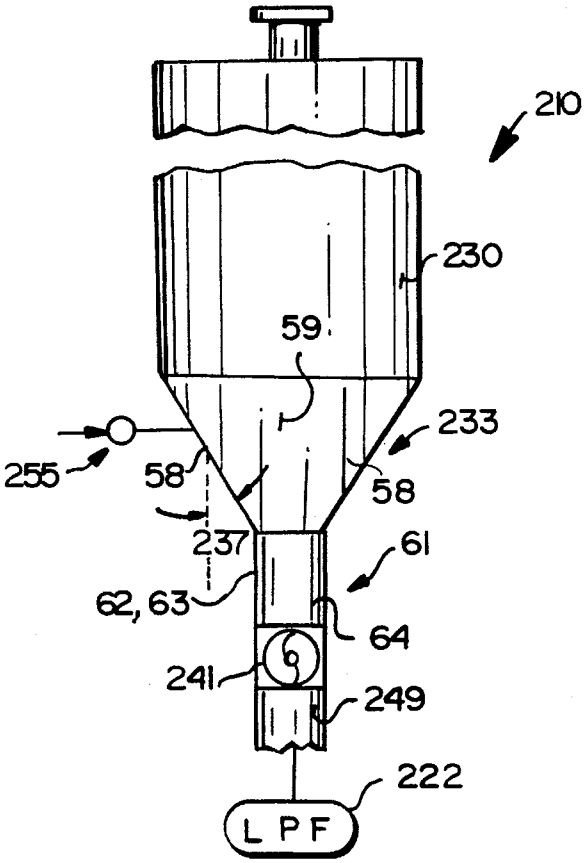
FIGS. 6 and 7 are views like that of FIGS. 2 and 3 only for a second embodiment of a chip bin according to the invention.
Figure 6:
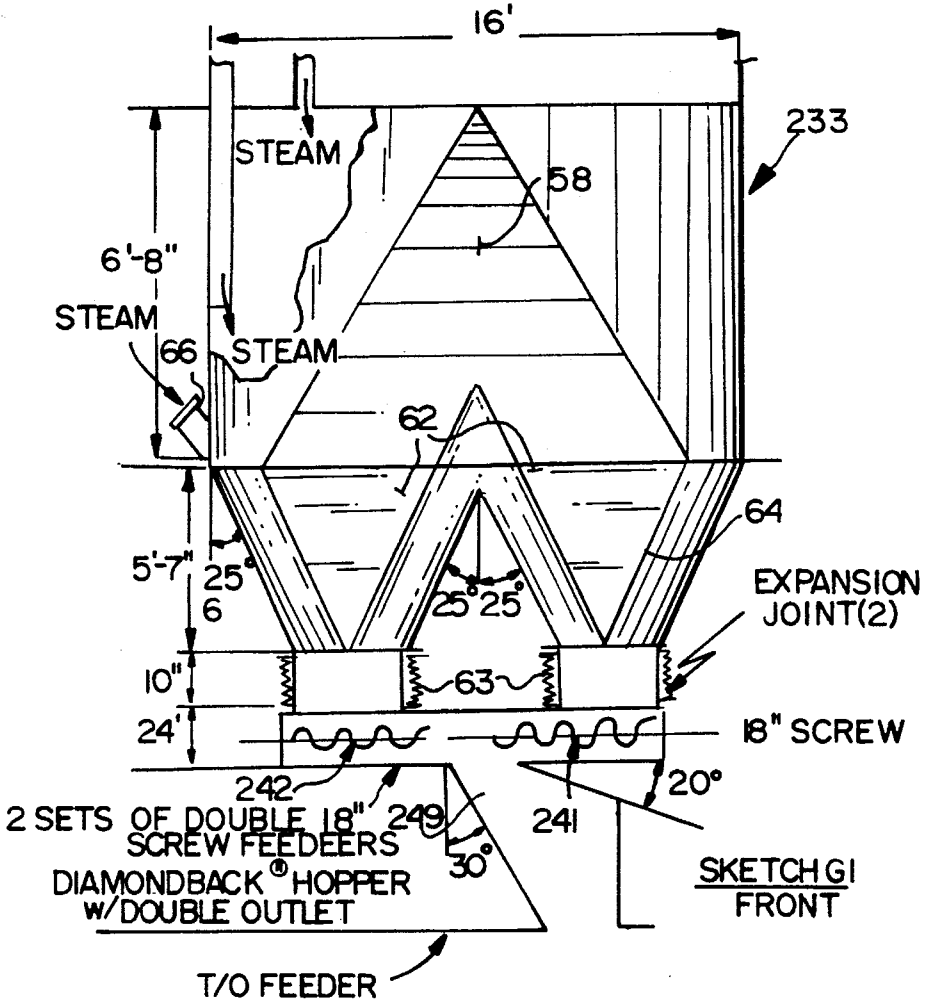

FIGS. 6 and 7 illustrate another embodiment of chip bin according to the invention. Components in the FIGS. 6 and 7 embodiment comparable to those in the FIGS. 1 through 5 embodiments are shown by the same two digit reference numeral only preceded by a "2".

In the FIGS. 6 and 7 embodiment, the hollow substantially right circular cylindrical main body portion 230 is the same as the main body portion 30 in the FIGS. 2 through 5 embodiment, as are the screws 241, 242, and associated components at the bottom of the chip bin 210 to their counterparts. The difference between the FIGS. 6 and 7 embodiment and the FIGS. 2 and 3 embodiment is the nature of the transition 233.

The transition 233 of FIGS. 6 and 7 incorporates the basic design features of U.S. Pat. No. 4,958,741 (the disclosure of which is hereby incorporated by reference herein) which is supplied commercially under the trademark "Diamond Back Hopper" by J. R. Johanson, Inc. of San Luis Obispo, Calif. The hollow transition portion 233 has one dimensional convergence and side relief, provided by triangular shaped substantially flat side panels 58 connected together by curved end wall portions 59, the portions 58 making an angle 237 comparable to the angle 37 in the FIGS. 2 and 3 embodiment (e.g. about 20°–35°). In the FIGS. 6 and 7 embodiment a second hollow transition 61, having generally the configuration of a rectangular parallelepiped (with rounded ends) has flat triangular, substantially vertical side panels 62 on each side thereof, and rounded end portions 64, and leads the chips from the transition 233 to the screws 241, 242, in two separate flow paths, with the one dimensional convergence and side relief of each minimizing the possibility of hangup (bridging). Expansion joints 63 preferably mount each of the sides of second transition 61 defining different flow paths to the housing for screws 241, 242.

Figure 9:
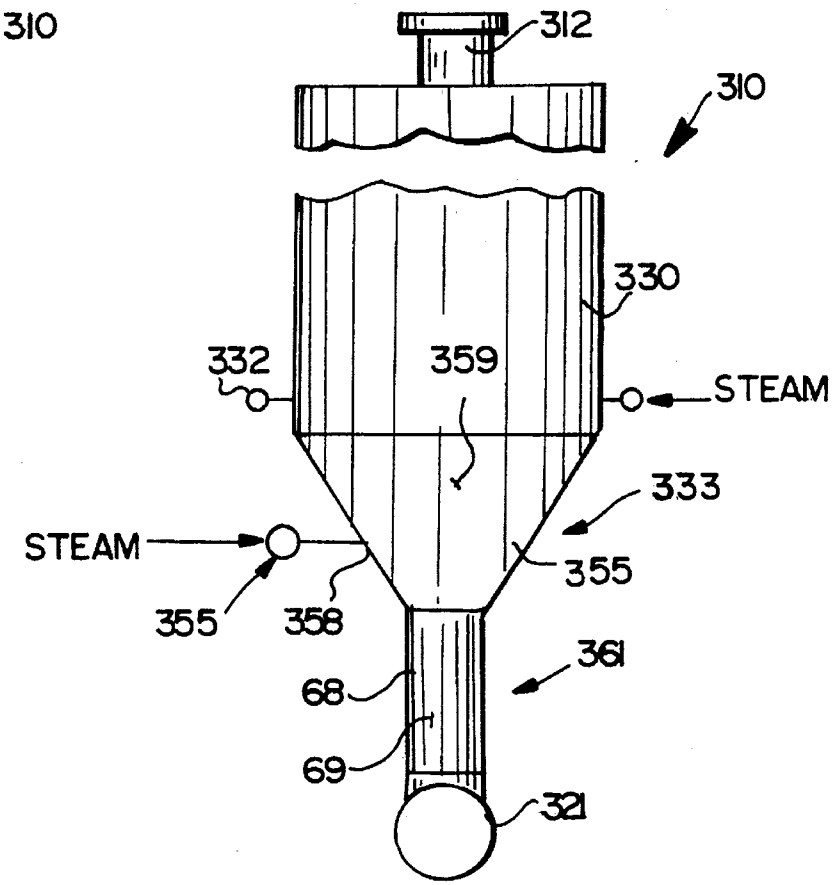
FIGS. 8 and 9 are views like those of FIGS. 2 and 3 for a third embodiment of a chip bin according to the present invention.
Figure 8:
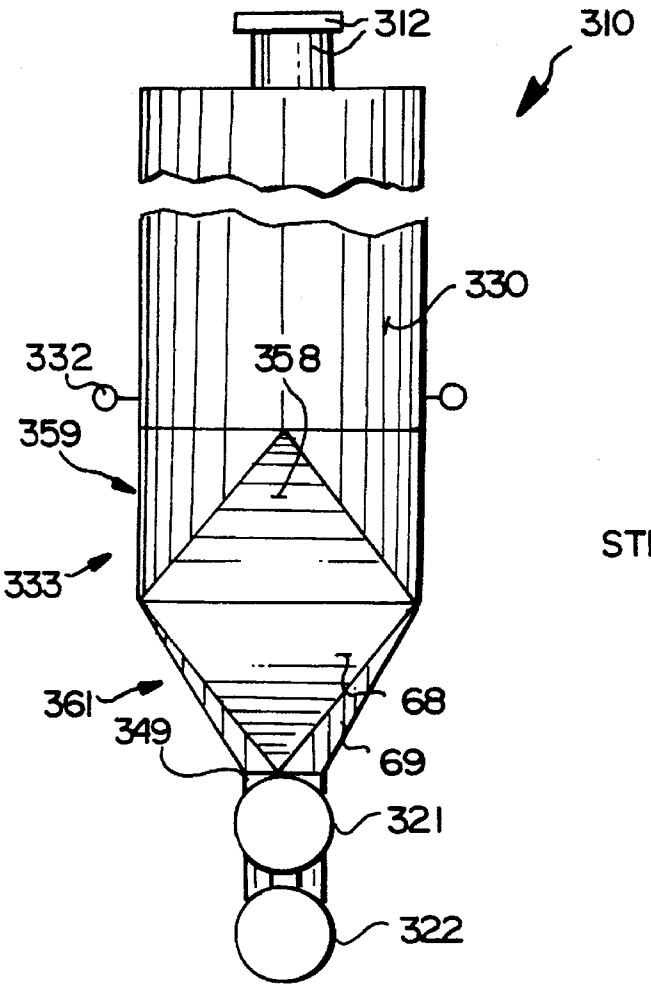

In the FIGS. 8 and 9 embodiment, components comparable to those in the FIGS. 1 through 7 embodiments are shown by the same two digit reference numeral only preceded by a "3". For the chip bin 310 of FIGS. 8 and 9, no screws 41, 42, 241,242 are provided, and rather the metering function they provide is instead supplied by the conventional chip meter 321. In the FIGS. 8 and 9 embodiment again one dimensional convergence and side relief is provided, in this case using components having the same basic configuration as those illustrated in FIGS. 1 and 2 in U.S. Pat. No. 4,958,741. While the transition 333 is substantially the same as the transition 233, the transition 361 is different, having the triangular side walls 68 which are substantially flat, and connected together by the curved end portions 69, providing the smooth transition from the substantially rectangular bottom of the transition 333 to the circular discharge 349, having a configuration similar to that of a truncated right triangular prism.

Figure 10:
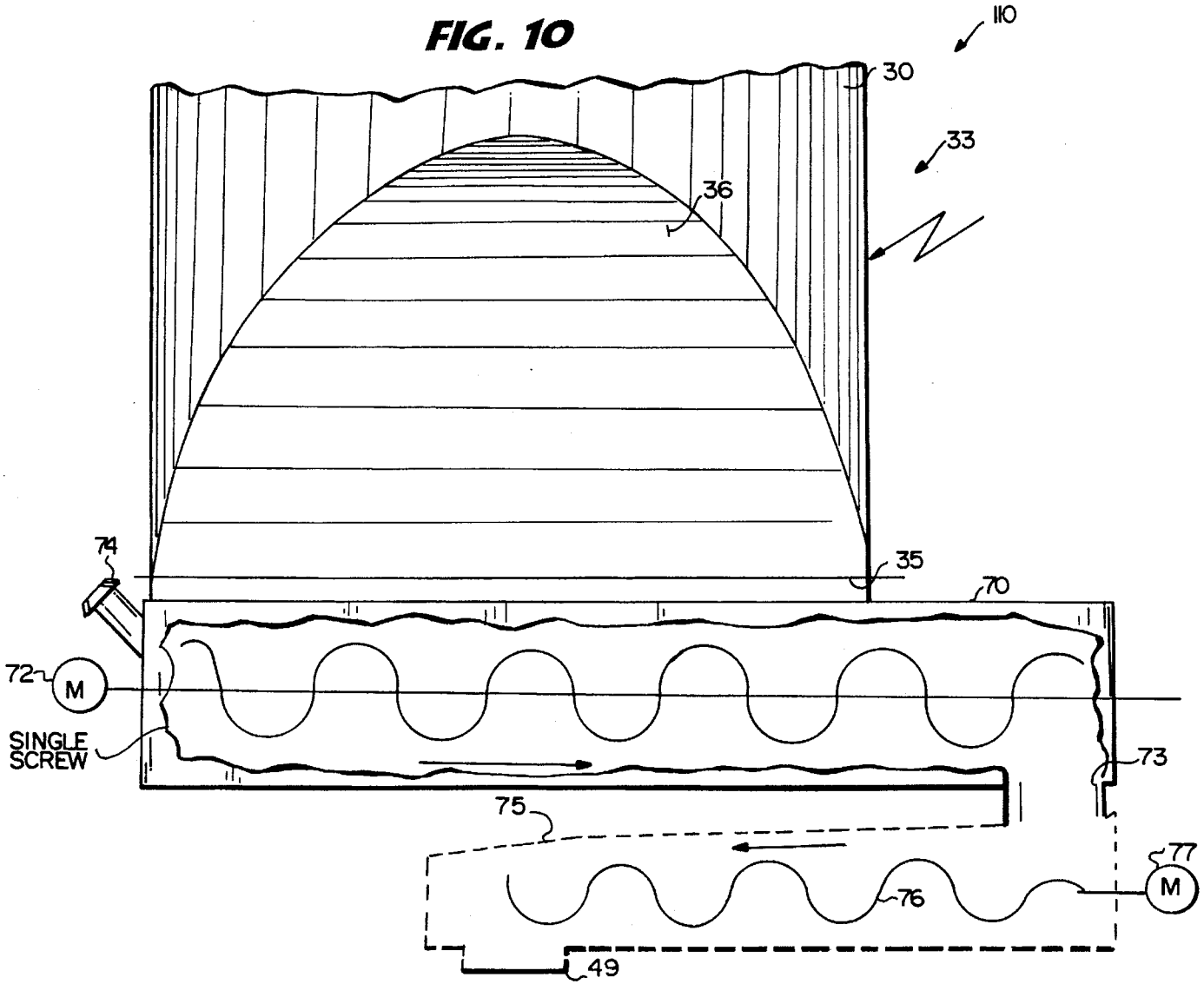
FIG. 10 is a detail front view, with portions cut away to illustrate internal components, of a modified form of the transition and screw components only of the embodiment of FIGS. 2 and 3.

In the construction of the FIGS. 2 through 5 embodiment, some time there are restrictions on the sizes of components that are too restrictive for some installations. The necessary dimensional relationship that provides such restrictions is—as earlier indicated—the necessity of having the length of the outlet of the transition at least about 2.5 times the outlet width for proper feeding. In the embodiment of FIG. 10 this is accommodated by providing a single screw 71 in a screw housing 70 mounted to the substantially rectangular open bottom 35 of the transition 33, the screw 71 driven by the motor 72 and moving the chips in the direction of the arrow illustrated in FIG. 10 to an outlet 73 that is offset with respect to the main body portion 30 (and transition 33). A conduit 74 may be provided in the housing 70 at the end thereof remote from the outlet 33 to act as a vent, or to allow steam for steaming the chips to be introduced thereat.

Under some circumstances, it is possible to provide the outlet 73 as the direct connection to a low pressure feeder, or the rest of the digester system 27 (from FIG. 1), however in many situations it is more desirable to have the ultimate discharge from the chip bin to be concentric with the vertical axis of the main body portion 30. In order to accommodate this, a second screw 76 in screw housing 75, located below the first screw 71 and first screw housing 70, and illustrated in dotted line in FIG. 10, is provided. The screw 76, driven by motor 77, moves the chips from the conduit 73 back toward the center of the chip bin 110 to the substantially right rectangular parallelepiped discharge 49 which is concentric with the main body portion 30. The screws 71, 76 preferably rotate about parallel axes in a common substantially vertical plane.

The embodiment of FIGS. 11 through 12 deals with the same dimensional problem that the FIG. 10 embodiment deals with only in a different way. In the FIGS. 11 through 12 embodiment, a second hollow transition portion 80 is provided between the first transition portion 33 and the at least one screw (screws 41, 42 in FIGS. 11 through 13). The second hollow transition 80 has a cross-sectional configuration substantially the same as a race course oval with substantially vertical side walls 81 but with the end walls 82 thereof slightly curved, and with a baffle 83 located in the center bottom portion thereof above the junction 47. The open top 84, which has the same cross-sectional area as the open bottom 35 of the first transition 33, is smaller than the cross-sectional area of the open bottom 85, both the top 84 and bottom 85 being substantially oval (as seen in FIG. 13). FIG. 13 illustrates the dimensional relationship that is highly desirable, namely the width W of the bottom 35/top 84 (which is essentially the same as the diameter of the screws 41, 42) requires an outlet length (for each screw 41, 42) greater than about 2.5 W.

In the FIGS. 11 through 13 embodiment, the discharge 49 is substantially concentric with the main body portion 30 yet the desired dimensional relationship W/greater than 2.5 W, is readily achieved. The baffle 83 divides the flow of chips into two different volumes, and prevents short circuiting of the chips directly to the discharge 49.

FIGS. 14 and 15 show an embodiment similar to that in FIGS. 2 and 3 only without a baffle. Since the central discharge 49 could be prone to short circuiting, a conventional chip meter 121 is included in this embodiment, run by a motor 86, even though the screws 41, 42 are provided. With such an arrangement it is necessary to control the speeds of the motors 45, 46 (or a single motor taking the place of motors 45, 46), 86 to prevent starvation of the chip meter 121, as by using the controller 87. Also in this embodiment there is the possibility of chip hangup at the junction between the screws 41, 42, and to eliminate this possibility it is desirable to provide the agitator 88, driven by a motor 89, located at the junction between the screws 41, 42. Thus in this embodiment the screws 41, 42 do not provide a metering function (as they do, for example, in the FIGS. 2 and 3 embodiment), but rather only a transporting function, facilitated by the agitator 88.

Figure 16:
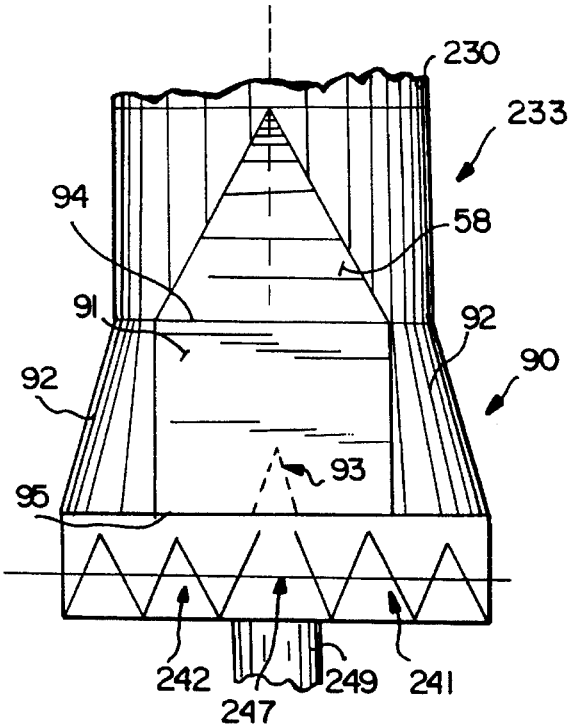
FIGS. 16 and 17 are views like those of FIGS. 6 and 7 only for the transition and screw feed portions only, of yet another embodiment according to the present invention, the plan view of the structures of FIGS. 16 and 17 being essentially the same as the plan view of FIG. 13.
Figure 17:
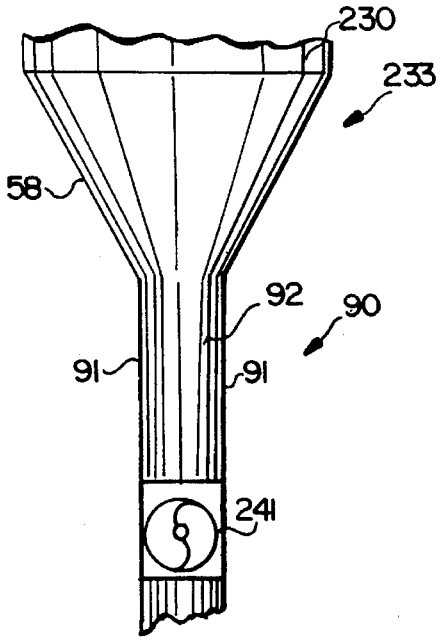

In the FIGS. 16 and 17 embodiment, the same advantages with respect to the length/diameter ratio of the screws 241, 242 as are obtained in the FIGS. 11 through 13 embodiment for the "chisel" bin design are obtained for the "Diamond Back"® design of FIGS. 6 and 7. That is below the transition 233 instead of the substantially rectangular parallelepiped transition 61 a truncated substantially right triangular prism (with rounded ends, simulating a race tack oval) transition 90 is provided, having substantially vertical planar side plates 91, and the rounded ends 92. A baffle 93 is mounted within the transition 90 above the junction 247 for the screws 241, 242 to divide the chips flow into two different volumes. The second transition 90 has a substantially rectangular shaped open top 94 and a substantially rectangular shaped open bottom 95, the area of the open top 94 being significantly less than the area of the open bottom 95.

While the chip bins according to the invention can be used as bins per se rather than exclusively in chemical pulping systems, they are particularly suitable for use with a method of feeding comminuted cellulose material to a digester and where they have a maximum diameter of about twelve feet or more, and with a discharge which is operatively connected to a digester and has a cross-sectional area less than half of the cross-sectional area of the chip bin. With respect to the FIGS. 2 and 3 embodiment in particular, the comminuted cellulose material is fed into the top of the chip bin 110 through the conduit 112, to flow downwardly in a column in the chip bin 110 toward the bottom (where the discharge 49 is located). The comminuted cellulose material is caused to move in a gradually restricting open flow path in the interior of the chip bin until the open flow path has a cross-sectional area (in the transition 33) less than half of the cross-sectional area at the maximum diameter portion (30) of the chip bin 110. Then without vibrating the chip bin or the chip bin discharge, a substantially uniform flow of the comminuted cellulose material is provided in the gradually restricting open flow path, substantially without bridging of the cellulose material. While in the bin, and typically also while in the gradually restricting open flow path, the comminuted cellulosic material is steamed, as by introducing steam at 32 and 55 (see FIGS. 2 and 5), and subsequently the partially steamed comminuted cellulosic material is discharged from the bottom of the transition 33, metered by the screws 41, 42, into the discharge 49. From the discharge 49 the cellulose material is fed to the digester (27 in FIG. 1), as through the low pressure feeder 122 and the other conventional components illustrated in FIG. 1.

While the invention has been herein shown and described in what is presently conceived to be the most practical and preferred embodiment thereof it will be apparent to those in ordinary skill in the art that many modifications may be made thereof within the scope of the invention, which scope is to be accorded the broadest interpretation of the appended claims so as to encompass all equivalent structures and methods.

What is claimed is:

1. A method of feeding comminuted cellulosic material to a digester using a vertical open interior chip bin having a top and bottom, a maximum diameter of at least about twelve feet, and a discharge operatively connected to a digester, the discharge having a cross-sectional area less than half of the cross-sectional area of the chip bin at the maximum diameter thereof, comprising the steps of:

(a) feeding the comminuted cellulosic material into the top of the chip bin, to flow downwardly in a column in the chip bin toward the bottom;

(b) causing the comminuted cellulosic material to move into a gradually restricting open flow path through a transition having one dimensional convergence and side relief in the open interior of the chip bin, the open interior of the chip bin having a cross-sectional area less than half of the area at the maximum diameter of the chip bin;

(c) without vibrating the chip bin or the chip bin discharge, causing a substantially uniform flow of the comminuted cellulosic material in the gradually restricting open flow path through said transition, substantially without bridging or hangups of the comminuted cellulosic material in the flow path through said transition;

(d) steaming the comminuted cellulosic material while in the chip bin; and (e) discharging the comminuted cellulosic material from the chip bin discharge and feeding it to the digester.

2. A method as recited in claim 1 wherein step (e) is practiced by feeding the comminuted cellulosic material directly from the discharge to a low pressure feeder, and then from the low pressure feeder to the digester.

3. A method as recited in claim 1 wherein step (e) is practiced by feeding the comminuted cellulosic material directly from the discharge to a chip meter, and then ultimately from the chip meter to the digester.

4. A method as recited in claim 1 wherein steps (b) and (c) are practiced by causing the comminuted cellulosic material to flow into two distinct volumes with each distinct volume containing a transition having one dimensional convergence and side relief, each distinct volume comprising about half of a main volume defined by a substantially circular cross-section top and a substantially rectangular cross-section bottom, and a larger cross-sectional area at the top thereof than at the bottom thereof, and causing the material to move from each distinct volume to the discharge using oppositely directed feed screws, the discharge being located approximately midway between the two distinct volumes.

5. A method as recited in claim 4 wherein step (d) is practiced by adding steam to the distinct volumes by introducing the steam into a substantially vertical chip bin wall interruption in one of the non-vertical gradually tapering side of each of the distinct volumes of the chip bin.

6. A method as recited in claim 4 wherein the chip bin has at least one substantially flat wall portion; and wherein step (d) is practiced by introducing steam into the at least one substantially flat wall portion.

7. A method as recited in claim 4 wherein step (e) is practiced by feeding the comminuted cellulosic material directly from the discharge to a low pressure feeder, and then from the low pressure feeder to the digester.

8. A method as recited in claim 4 wherein step (e) is practiced by feeding the comminuted cellulosic material directly from the discharge to a chip meter, and then the chip meter to the digester.

9. A method as recited in claim 1 wherein steps (b) and (c) are further practiced by causing the comminuted cellulosic material when flowing in the flow path through the transition having one dimensional convergence and side relief, to flow between a first volume having a circular cross-section of at least about twelve feet and a discharge having a rectangular cross-sectional area of less than half of the first volume.

10. A method as recited in claim 9 wherein steps (b) and (c) are further practiced to cause the comminuted cellulosic material to flow through a second transition from the rectangular cross-sectional area discharge to a circular cross-section second discharge having a cross-sectional area less than that of the rectangular cross-sectional area.

11. A method as recited in claim 9 wherein the chip bin has at least one substantially flat wall portion; and wherein step (d) is practiced by introducing steam into the at least one substantially flat wall portion.

12. A method as recited in claim 9 wherein step (e) is practiced by feeding the comminuted cellulosic material directly from the discharge to a low pressure feeder, and then from the low pressure feeder to the digester.

13. A method as recited in claim 9 wherein step (e) is practiced by feeding the comminuted cellulosic material directly from the discharge to a chip meter, and then from the chip meter to the digester.

14. A method as recited in claim 1 wherein the chip bin has at least one substantially flat wall portion; and wherein step (d) is practiced by introducing steam into the at least one substantially flat wall portion.

15. A method as recited in claim 1 wherein the chip bin has a substantially vertical wall interruption and a gradually tapering side; and wherein step (d) is practiced by adding steam at the wall interruption.

16. A method as recited in claim 1 wherein step (e) is practiced by first passing the material when it immediately leaves the chip bin in a first generally horizontal direction, and then reversing its direction and passing it in a second horizontal direction substantially opposite the first direction.

* * * * *